US006305681B1

(12) United States Patent
Watanabe et al.

(10) Patent No.: US 6,305,681 B1
(45) **Date of Patent: *Oct. 23, 2001**

(54) SHEET PROCESSING APPARATUS WITH OPEN/CLOSE SWITCHABLE SHEET DISCHARGING MEMBER

(75) Inventors: Tetsuji Watanabe, Chiryu; Kazuya Tsutsui; Yoshiaki Ushirogata, both of Tokyo, all of (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/120,343

(22) Filed: Jul. 22, 1998

(30) Foreign Application Priority Data

Jul. 22, 1997 (JP) ..... 9-195888
Jun. 25, 1998 (JP) ..... 10-179170

(51) Int. Cl.[7] ..... B65H 39/05

(52) U.S. Cl. ..... 270/58.08; 270/58.12; 270/58.13; 270/58.17

(58) Field of Search ..... 270/58 V, 58.07, 270/58.08, 58.12, 58.13, 58.17; 271/278, 279, 288, 289, 300

(56) References Cited

U.S. PATENT DOCUMENTS

| | | | |
|---|---|---|---|
| 5,037,077 | 8/1991 | Kubota et al. . | |
| 5,056,774 | 10/1991 | Kubota et al. . | |
| 5,072,920 | 12/1991 | Kubota et al. . | |
| 5,083,760 | 1/1992 | Yamazaki et al. . | |
| 5,121,911 | 6/1992 | Yamazaki et al. . | |
| 5,263,697 | 11/1993 | Yamazaki et al. . | |
| 5,320,336 | 6/1994 | Asami . | |
| 5,508,798 | 4/1996 | Yamada . | |
| 5,762,328 * | 6/1998 | Yamada et al. | 270/58.08 |
| 5,765,824 * | 6/1998 | Kawano et al. | 270/58.11 |

FOREIGN PATENT DOCUMENTS

| | | |
|---|---|---|
| 2-276691 | 11/1990 | (JP) . |
| 5-305786 * | 11/1993 | (JP) . |
| 6-211415 | 8/1994 | (JP) . |

* cited by examiner

*Primary Examiner*—Christopher P. Ellis
*Assistant Examiner*—Patrick Mackey
(74) *Attorney, Agent, or Firm*—Oblon, Spivak, McClelland, Maier & Neustadt, P.C.

(57) ABSTRACT

A sheet processing apparatus includes a sheet conveying path for receiving a sheet conveyed from the outside and conveying the sheet therethrough to be discharged, a stack tray for stacking a plurality of the conveyed sheets for stapling, a stapler for stapling the plurality of the sheets stacked on the stack tray, and an output tray for receiving the discharged sheets. The sheet conveying path includes a first conveying path for guiding the conveyed sheet to the stack tray for stapling, and a second conveying path for guiding the conveyed sheet to the output tray bypassing the stack tray. The sheet processing apparatus further includes a discharging member for discharging the conveyed sheet or the sheets guided by the first conveying path or second conveying path, a discharging member switching device which selectively switches the discharging member to a closed condition for discharging the sheet or sheets by sandwiching them or to an open condition for discharging the sheet or sheets without sandwiching them, and a controller configured to control the discharging member switching device to switch the discharging member to the open condition before a tip end of the sheet being conveyed through the first conveying path reaches the discharging member.

13 Claims, 9 Drawing Sheets

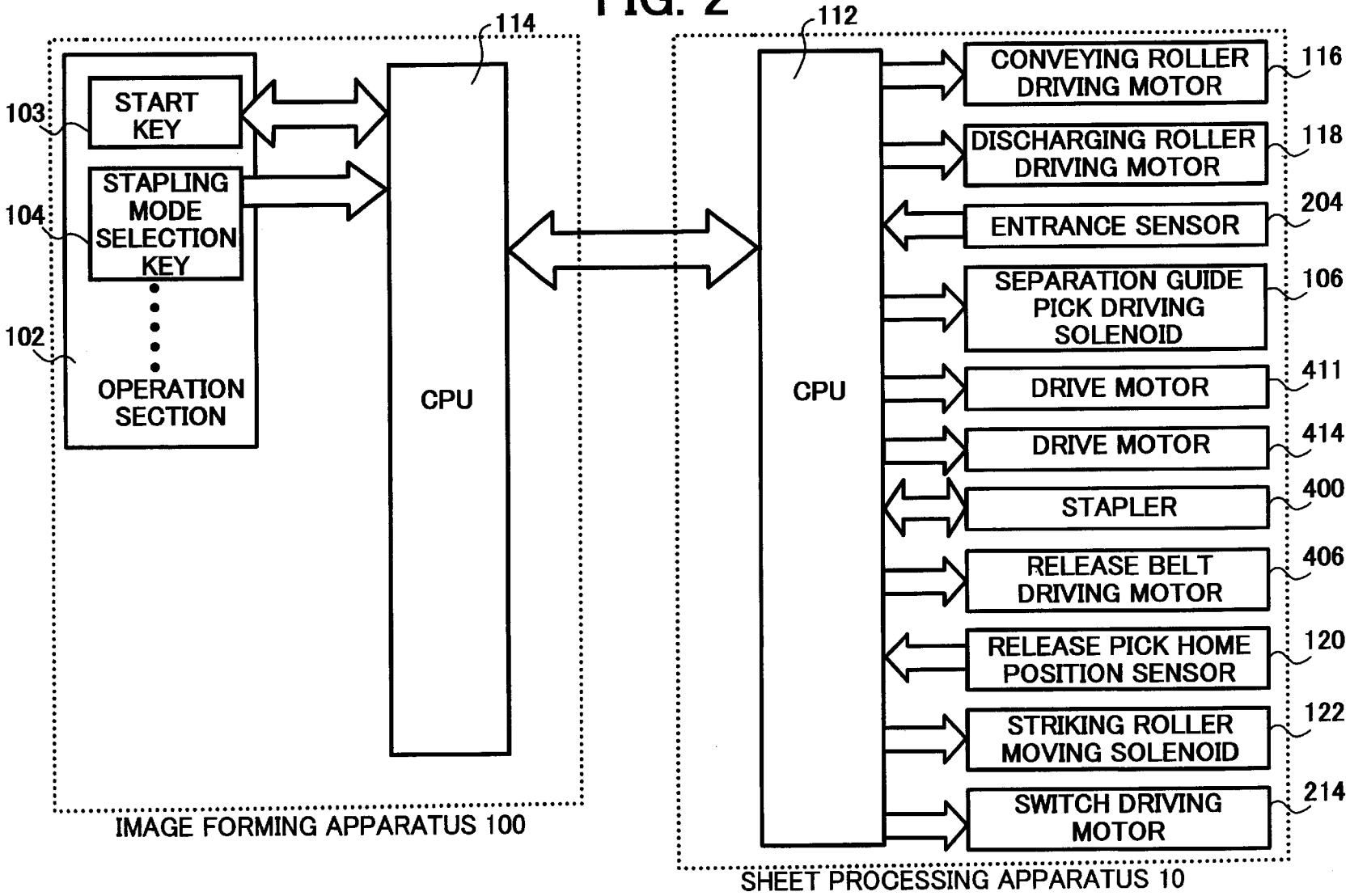
FIG. 2
CONVEYING ROLLER DRIVING MOTOR
116
DISCHARGING ROLLER DRIVING MOTOR
118
ENTRANCE SENSOR
204
SEPARATION GUIDE PICK DRIVING SOLENOID
106
DRIVE MOTOR
411
DRIVE MOTOR
414
STAPLER
400
RELEASE BELT DRIVING MOTOR
406
RELEASE PICK HOME POSITION SENSOR
120
STRIKING ROLLER MOVING SOLENOID
122
SWITCH DRIVING MOTOR
214
CPU
112
SHEET PROCESSING APPARATUS 10
CPU
114
START KEY
103
STAPLING MODE SELECTION KEY
104
OPERATION SECTION
102
IMAGE FORMING APPARATUS 100

SHEET PROCESSING APPARATUS WITH OPEN/CLOSE SWITCHABLE SHEET DISCHARGING MEMBER

BACKGROUND OF THE INVENTION

1. Field of the Invention

This invention relates to a sheet processing apparatus having a stapler function to staple sheets discharged from an image forming apparatus such as a copying machine, a facsimile, a printer, an offset printer, or the like, and more particularly to a sheet processing apparatus with an open/close switchable sheet discharging member for discharging a non-stapled sheet and stapled sheets.

2. Discussion of the Background

A sheet processing apparatus having a stapler function to staple sheets discharged from an image forming apparatus generally includes a function of stapling sheets and then discharging the stapled sheets, in addition to a function of discharging sheets without stapling. Further, such a sheet processing apparatus generally includes an output tray which receives sheets which are discharged after being stapled and the sheets discharged without being stapled as well.

FIG. 8 is a schematic drawing illustrating a configuration of a sheet processing apparatus disclosed, for example, in Japanese Patent Laid Open Publication No.5-305786. A sheet P conveyed from an image forming apparatus 500 is selectively guided either to a first conveying path 504 for stapling or a second conveying path 506 for discharging the sheet without stapling by an operation of a separation guide pick 502. The separation guide pick 502 operates in accordance with a selection between stapling and non-stapling modes.

In the stapling mode, the sheet P is guided to the first conveying path 504 and is stacked and aligned on a stack tray 508. Then, a plurality of the sheets P stacked in the stack tray 508 are stapled by a stapler (not shown) and the stapled sheets are pushed out by a sheets pushing up member (not shown) in the direction indicated by a broken arrow in the drawing and are discharged to an output tray 512 while being supported and sandwiched by a discharging member 510, provided at an exit of the sheet processing apparatus, for discharging the sheet therefrom. In the non-stapling mode, the sheet P is guided to the second conveying path 506 and discharged to the output tray 512 after being supported and sandwiched by the discharging member 510.

The discharging member 510 includes a pair of rollers, including a drive roller 514 and a driven roller 516. The driven roller 516 is selectively brought into and out of contact with the drive roller 514 in the direction indicated by an arrow. When the sheets P are started to be discharged (pushed upward) from the stack tray 508 in the stapling mode, the driven roller 516 moves apart from the drive roller 514 so that the discharging member 510 is in an open condition for discharging the sheets P without sandwiching them. The sheets P are started to be pushed upward through the discharging member 510 in this open condition. A discharging sensor (not shown) is provided adjacent to and upstream in the sheet conveying direction of the discharging member 510. When the discharging sensor detects the tail end of the sheets, the discharging member 510 changes to a closed condition with the driven roller 516 returned to the position to contact the drive roller 514. Thereafter, the sheets P are discharged to the output tray 512 being supported and sandwiched by the discharging member 510.

If the discharging member 510 supports and sandwiches the sheets P at an earlier timing, in other words if the discharging member 510 supports and sandwiches the sheets P from the tip portion of the sheets P in the conveying direction, the following problem arises. As illustrated in FIG. 9(*a*), when a curl of a stapled stack of sheets P is large, there exists a deviation of placements between the top and bottom sheets in the sheet conveying direction. Because the sheets P are stapled at the tail end parts thereof, the top side sheets of the stapled stack of sheets P gradually bulge resulting from being sandwiched and pressed by the rollers 514 and 516. As illustrated in FIG. 9(*b*), a bulge E is transferred toward the tail end parts of the sheets as the bulge E is pressed by the rollers 514 and 516, but the bulge E cannot be eliminated because the sheets P are stapled at the tail end parts of the sheets. The bulge E is pressed by the rollers 514 and 516 finally. This makes the sheets P thicken in the vicinity of the tail end of the sheets and as a consequence the sheets may not be discharged smoothly through the rollers 514 and 516. Though the above-mentioned problem is not described in the Japanese Patent Laid Open Publication No.5-305786, it seems that the problem does not exist in the sheet processing apparatus of the above publication because the sheets are started to be supported and sandwiched by the rollers after the discharging sensor provided in the vicinity of the discharging member 510 detects the tail end of the sheets.

However, in the sheet processing apparatus disclosed in the Japanese Patent Laid Open Publication No.5-305786, the discharging member 510 changes to the open condition from the closed condition when the stapled sheets are started to be discharged (pushed out) from the stack tray 508. Therefore, in order to stack and align sheets of every size in the conveying direction for stapling in the stack tray 508, a space for accommodating the biggest sized sheet is necessary between the discharging member 510 and the bottom part of the stack tray 508. Therefore, the apparatus is hard to be made compact, irrespective of the presence or absence of the non-stapling mode. In addition, the first conveying path for stapling and the second conveying path for non-stapling are located apart from each other with an open space existing between them, further making it harder to realize a compact design.

SUMMARY OF THE INVENTION

Accordingly, one object of the present invention is to provide a sheet processing apparatus that can realize a compact design irrespective of the presence or absence of non-stapling mode using an open/close switching structure of a discharging member for discharging sheets.

A sheet processing apparatus according to the present invention includes a sheet conveying path for receiving a sheet conveyed from the outside and conveying the sheet therethrough to be discharged, a stack tray for stacking a plurality of the conveyed sheets for stapling, a stapling device for stapling the plurality of the sheets stacked on the stack tray, and an output tray for receiving the discharged sheets. The sheet conveying path includes a first conveying path for guiding the conveyed sheet to the stack tray for stapling, and a second conveying path for guiding the conveyed sheet to the output tray bypassing the stack tray. The sheet processing apparatus further includes a discharging member for discharging the conveyed sheet or the sheets guided by the first conveying path or second conveying path, a discharging member switching device which selectively switches the discharging member to a closed condition for discharging the sheet or sheets by sandwiching them or to an open condition for discharging the sheet or sheets without sandwiching them, and a control device to control the discharging member switching device to switch the discharging member to the open condition before a tip end of the sheet being conveyed through the first conveying path reaches the discharging member.

In the above configuration, when a sheet is discharged to the stack tray, because the control device controls the discharging member switching device to switch the discharging member to the open condition before the conveyed sheet being conveyed toward the stack tray reaches the discharging member, a space downstream of the discharging member in the sheet conveying direction, that is, a space outside the apparatus, can be used as a part of the sheet conveying path. Therefore, a length of the stack tray or the distance from the entrance for the sheet to the stack tray to the nip portion of the discharging member can be shortened, and thereby the apparatus can be made compact.

Further, the control device controls the discharging member switching device to switch the discharging member to the closed condition from the open condition when a tail end of the sheets in the conveying direction or a stapled part of the sheets stapled by the stapling member reaches a predetermined position before the discharging member. Accordingly, because the stapled sheets are started to be sandwiched and conveyed by the discharging member after a large proportion of the sheets has been pushed up by the sheets pushing up device, bulges of the sheets caused by a deviation of placements between a top and bottom sheets of the stapled sheets when the sheets are sandwiched by the rollers of the discharging member are eliminated or at least reduced and thereby a problem of resistance caused by the bulges of the sheets when the sheets are discharged is solved. Thus, the stapled sheets are smoothly discharged.

Further, in the sheet processing apparatus of this invention, the distance from the entrance for a sheet to the stack tray to the nip portion of the discharging member is shorter than the length in the conveying direction of the biggest sized sheet stackable on the stack tray. This enables the apparatus to be small and compact.

Moreover, the first conveying path and second conveying path are formed substantially parallel to each other, and also the sheet stacking surface of the stack tray and the second conveying path are formed substantially parallel to each other. Owing to the above configuration, the space occupied by the sheet conveying paths and the stack tray is saved and the apparatus can be even smaller and more compact. In addition, the stack tray or the first conveying path and the second conveying path are slantingly provided so that each downstream side in the sheet conveying direction is positioned higher than each upstream side. This configuration enables the width of the apparatus to be narrow. Especially, the sheet falls down by the own gravity to be stacked and aligned in the stack tray.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 2 is a block diagram showing a control system of the sheet processing apparatus shown in FIG. 1;

DESCRIPTION OF THE PREFERRED EMBODIMENTS

Figure 1:
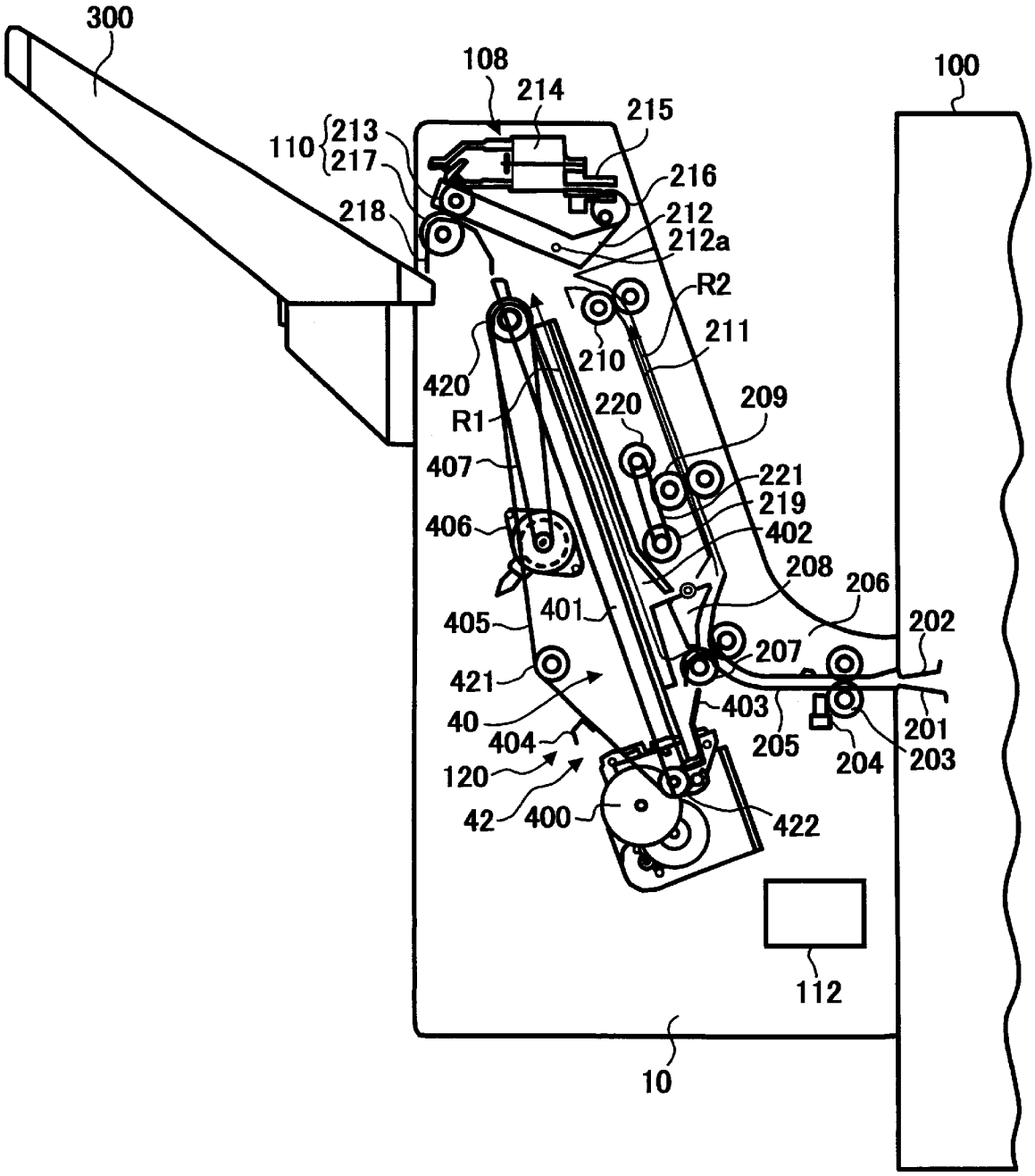
FIG. 1 is a schematic side elevational view showing an embodiment of a sheet processing apparatus according to the present invention.

Referring now to the drawings, wherein like reference numerals designate identical or corresponding parts throughout the several views, and more particularly to FIG. 1 thereof, there is illustrated a schematic side elevational view of an embodiment of a sheet processing apparatus according to the present invention.

As illustrated in FIG. 1, a sheet processing apparatus 10 is installed at a side of a copying machine 100, that is an image forming apparatus. The copying machine 100 has an operation section 102 (illustrated in FIG. 2) on which a stapling mode selection key 104 is provided for selecting a stapling mode or a non-stapling mode. A copying sheet (hereinafter called a sheet) discharged from the copying machine 100 is conveyed into the sheet processing apparatus 10 through between an upper relaying guide plate 202 and a lower relaying guide plate 201. The sheet is then conveyed into a conveying path formed by and between a conveying guide plate 206 and an entrance guide plate 205. Near an entrance of the above-mentioned conveying path defined by the guide plate 206 and the entrance guide plate 205, a pair of conveying rollers 203 is provided, and just downstream in a sheet conveying direction thereof, an entrance sensor 204 is provided for detecting the sheet conveyed into the sheet processing apparatus 10.

The conveying path between the conveying guide plate 206 and the entrance guide plate 205 is nearly horizontal in the vicinity of the entrance sensor 204, and then extends in a left slanting upward direction after a smooth curvature. The angle of the direction is approximately 45° in this embodiment. Immediately after the curvature, a pair of feeding rollers 207 and thereafter a separation guide pick 208 are provided, and then the conveying path separates into a first conveying path R1 for a stapling mode and a second conveying path R2 for a non-stapling mode. The separation guide pick 208 guides the sheet conveyed by the pair of feeding rollers 207 selectively to the first conveying path R1 or to the second conveying path R2. The first conveying path R1 and the second conveying path R2 are provided closely and substantially parallel to each other, and in slanting directions with each downstream side thereof in a sheet conveying direction positioned higher than each upstream side thereof, and an output tray 300 is provided downstream of the path R1 and path R2. The output tray 300 receives sheets conveyed either through the path R1 and the path R2.

The separation guide pick 208 is regularly positioned to guide a sheet to the second conveying path R2 for the non-stapling mode, as illustrated in FIG. 1. If the stapling mode is selected in the copying machine 100 (image forming apparatus), the separation guide pick 208 changes its position by an operation of a separation guide pick driving solenoid 106 (illustrated in FIG. 2) to guide the sheet to the first conveying path R1 as indicated by a two-dots-and-dash line in FIG. 3.

The second conveying path R2 is formed upward between the separation guide pick 208 and the conveying guide plate 206, and then in a left slanting upward direction between a vertical conveying guide plate 211 provided in the left slanting upward direction and the conveying guide plate 206. The second conveying path R2 is at approximately 70° relative to a horizontal surface in this embodiment. The sheet is conveyed by pairs of conveying rollers 209 and 210 through the second conveying path R2. Further, after the second conveying path R2 is curved downstream of the upper pair of conveying rollers 210, the path R2 is formed in a left slanting upward direction approximately 25° relative to the horizontal surface between a later described discharging member switching device 108 (discharging rollers switching device) and a discharging guide plate 218. The respective pairs of conveying rollers like the pair of conveying rollers 203 are driven by a conveying roller driving motor 116 (illustrated in FIG. 2).

Further, a discharging member 110 for discharging a sheet or a stack of sheets to the output tray 300 by sandwiching them is provided at an exit of the apparatus 10 through which the sheet is discharged to the output tray 300. The discharging member 110 includes a drive roller 217 supported by the discharging guide plate 218 and a driven roller 213. That is, the discharging member 110 includes a pair of discharging rollers. The drive roller 217 is driven by a discharging roller driving motor 118 (illustrated in FIG. 2). The discharging member 110 is capable of selectively being in a closed condition for discharging a sheet or a stack of sheets by sandwiching them (indicated by a two-dots-and-dash line in FIG. 1 and FIG. 4) or an open condition for discharging a sheet or a stack of sheets without sandwiching them (indicated by a solid line in FIG. 4). Changing of the condition is enabled by an operation of the driven roller 213 to contact or separate from the drive roller 217. A control device 112 controls the discharging member 110 to switch between the above-described closed and open conditions via the discharging member switching device 108.

Specifically, the discharging member switching device 108 is rotatively movable around the fulcrum of a shaft 212*a* and includes a supporting unit 212 which supports the driven roller 213 rotatively at one end, a switch driving motor 214, and a cylindrical eccentric cam 216 rotated by the switch driving motor 214 via a gear 215. FIG. 1 illustrates the closed condition of the discharging member 110, that is the condition in which the discharging member 110 discharges a sheet or a stack of sheets to the output tray 300 by sandwiching them. In this closed condition, a sheet or a stack of sheets are conveyed and discharged to the output tray 300 being sandwiched by the drive roller 217 and the driven roller 213, after being conveyed between the supporting unit 212 and the discharging guide plate 218.

Figure 3:
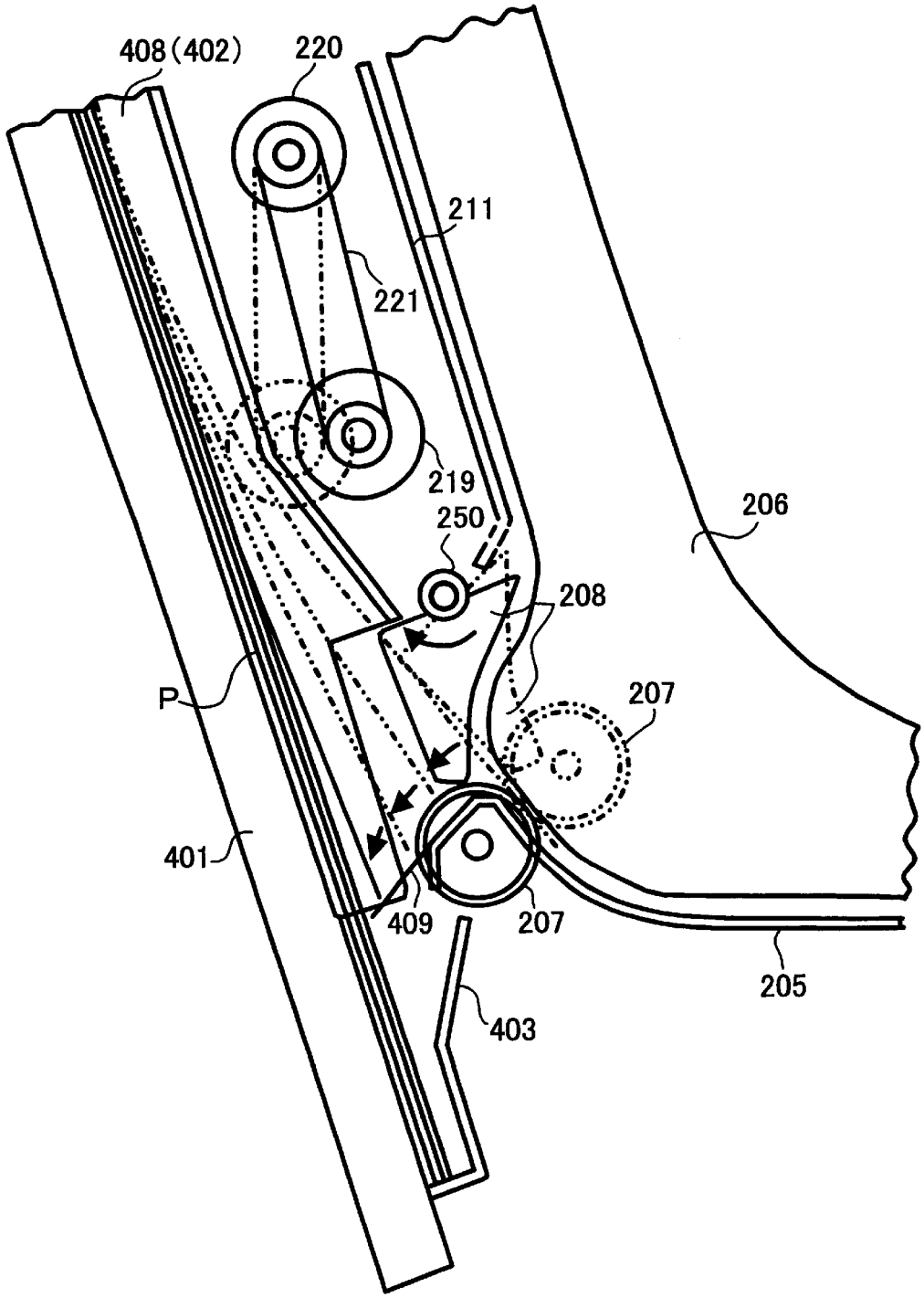
FIG. 3 is a magnified view of a main part of the apparatus shown in FIG. 1, illustrating a state that sheets are discharged to a stack tray in a stapling mode.
Figure 5:
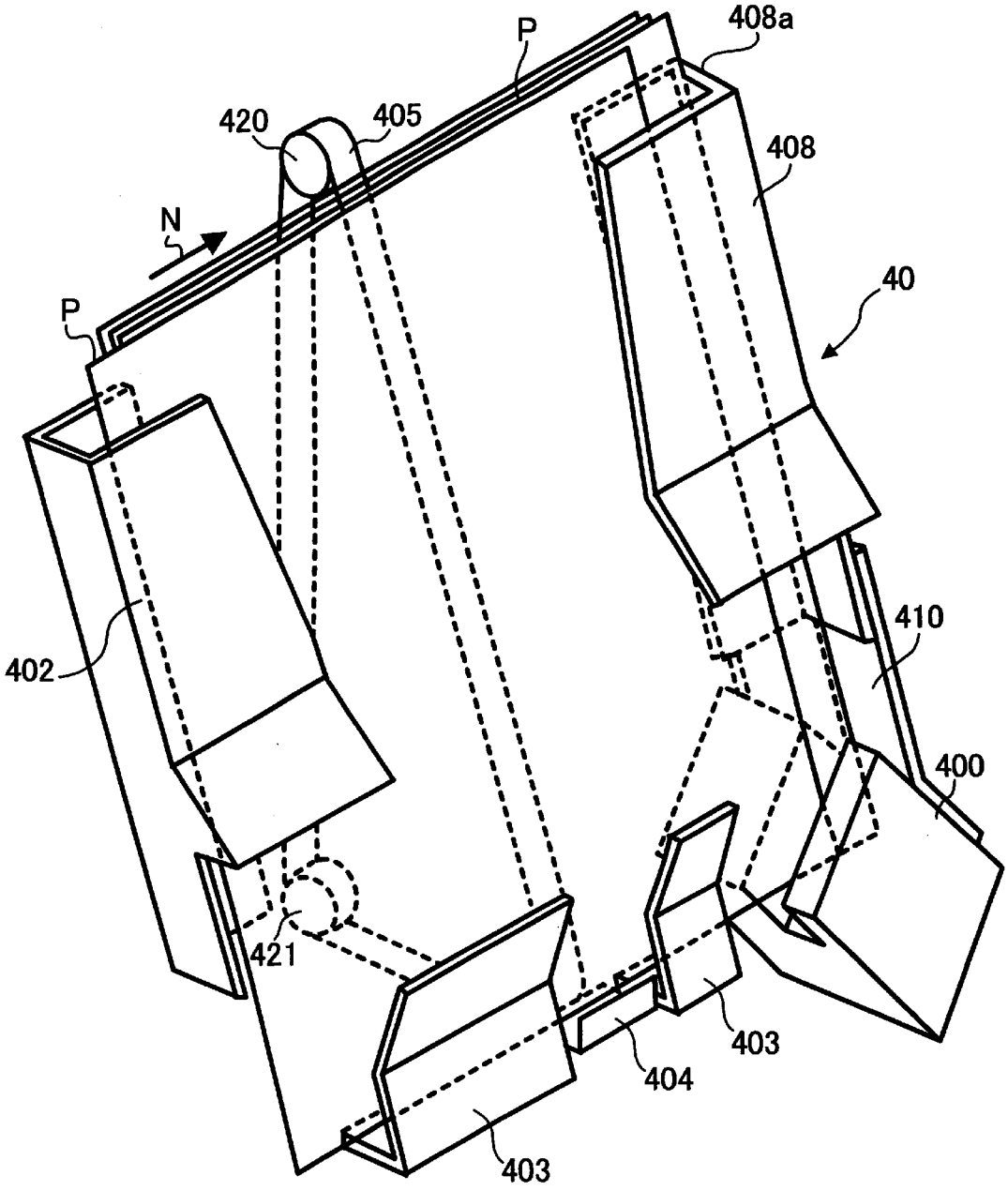
FIG. 5 is a perspective view showing a stapling device from the front.

As illustrated in FIG. 1, a stack tray (staple tray) 401 for stacking a plurality of sheets discharged from the copying machine 100 and a stapling device 40 for aligning and stapling the sheets stacked on the stack tray 401 are provided along the first conveying path R1. A sheet guided into the first conveying path R1 by the separation guide pick 208 is conveyed upward by the conveying rollers 207, and once the tail end of the sheet passes between the conveying rollers 207, the sheet drops downward by its own weight to be stacked in the stack tray 401. Then, the sheet P is aligned by a later described striking roller 219. The stapling device 40 includes a jogger fence 402 and a side fence 408 (both illustrated in FIG. 5) which are movable in a direction perpendicular to a sheet conveying direction to align the sheets stacked on the stack tray 401 in a direction parallel to the conveying direction, and an end fence 403 (illustrated in FIG. 5) provided at the upstream end of the stack tray 401 in the sheet conveying direction so that a tail end of the sheets discharged in the stack tray 401 in the sheet conveying direction abuts against the end fence 403 so as to be aligned. The stapling device 40 further includes a stapler 400 (illustrated in FIG. 5) for stapling the sheets aligned by the above jogger fence 402, the side fence 408, the end fence 403, and the striking roller 219 (illustrated in FIG. 1) which is capable of contacting or separating from a surface of the sheets stacked on the stack tray 401. As illustrated in FIG. 3, the striking roller 219 is supported by a supporting device 220 via an arm 221 to swing and rotate in a counterclockwise direction by a driving part (not shown). The arm 221 swings by an operation of a striking roller moving solenoid (illustrated in FIG. 2).

Figure 6:
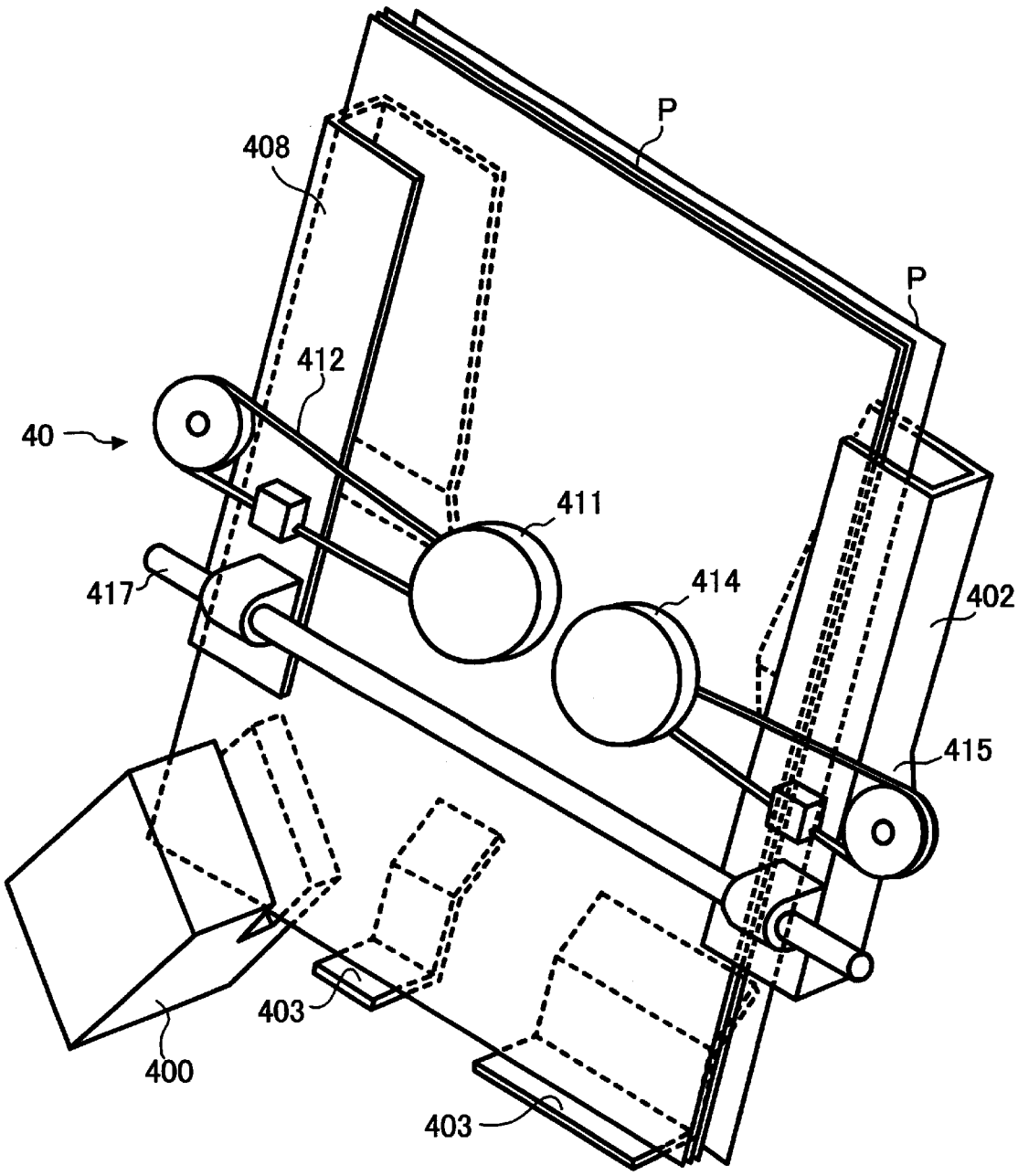
FIG. 6 is a perspective view showing the stapling device from the back.

Further, the stack tray 401 is provided slantingly, and further such that the downstream side thereof in the sheet conveying direction is positioned higher than the upstream side thereof and the surface of stacked sheets is substantially parallel to the second conveying path R2. As illustrated in FIG. 6, which is a perspective view of the stack tray 401 from the back side, both the jogger fence 402 and the side fence 408 extend in the sheet conveying direction parallel to each other and respectively have U-shapes in the cross section. The jogger fence 402 and the side fence 408 are mounted to the stack tray 401 movably in a direction perpendicular to the sheet conveying direction via a guide axis 417 with respective opening portions of the U-shapes opposed to each other. The jogger fence 402 is moved by a drive motor 414 and a timing belt 415 and the side fence 408 is moved by a drive motor 411 and a timing belt 412.

After the stack of sheets are stapled, a sheets pushing up device 42 pushes out the stapled sheets along the stack tray 401 toward the output tray 300. As illustrated in FIG. 1, the sheets pushing up device 42 includes a release belt 405 which is spanned around a pulley 420, 421, and 422 so as to form a portion that is substantially parallel to the stacking surface of the stack tray 401, a hook shaped release pick 404 protrudingly provided on the release belt 405, a timing belt 407 as transmission units, and a release belt driving motor 406 for driving the release belt 405 via the timing belt 407. As illustrated in FIG. 1, the home position of the release pick 404 is detected by a release pick home position sensor 120.

Next, the control operations of the sheet processing apparatus 10 according to the present invention are described first referring to FIG. 2.

When the power of the image forming apparatus 100 is turned on by manipulation of a start key 103 and mode setting is executed via the stapling mode selection key 104 at the operation section 102 of the image forming apparatus 100, the signals of the above operations are input to a CPU 114 of a microcomputer functioning as a controller controlling overall operations of the image forming apparatus 100. Of these input signals, the signals related to the sheet processing apparatus 10 are input to the control device 112 of the sheet processing apparatus 10. The control device 112 includes a microcomputer including a CPU and controls the conveying roller driving motor 116, the discharging roller driving motor 118, the separation guide pick driving solenoid 106, the drive motors 411 and 414, the stapler 400, the release belt driving motor 406, the striking roller moving solenoid 122, and the switch driving motor 214 in accordance with the input information from the image forming apparatus 100. In addition, signals from the entrance sensor 204, the stapler 400, and the release pick home position sensor 120 are inputted to the control device 112.

Figure 7:
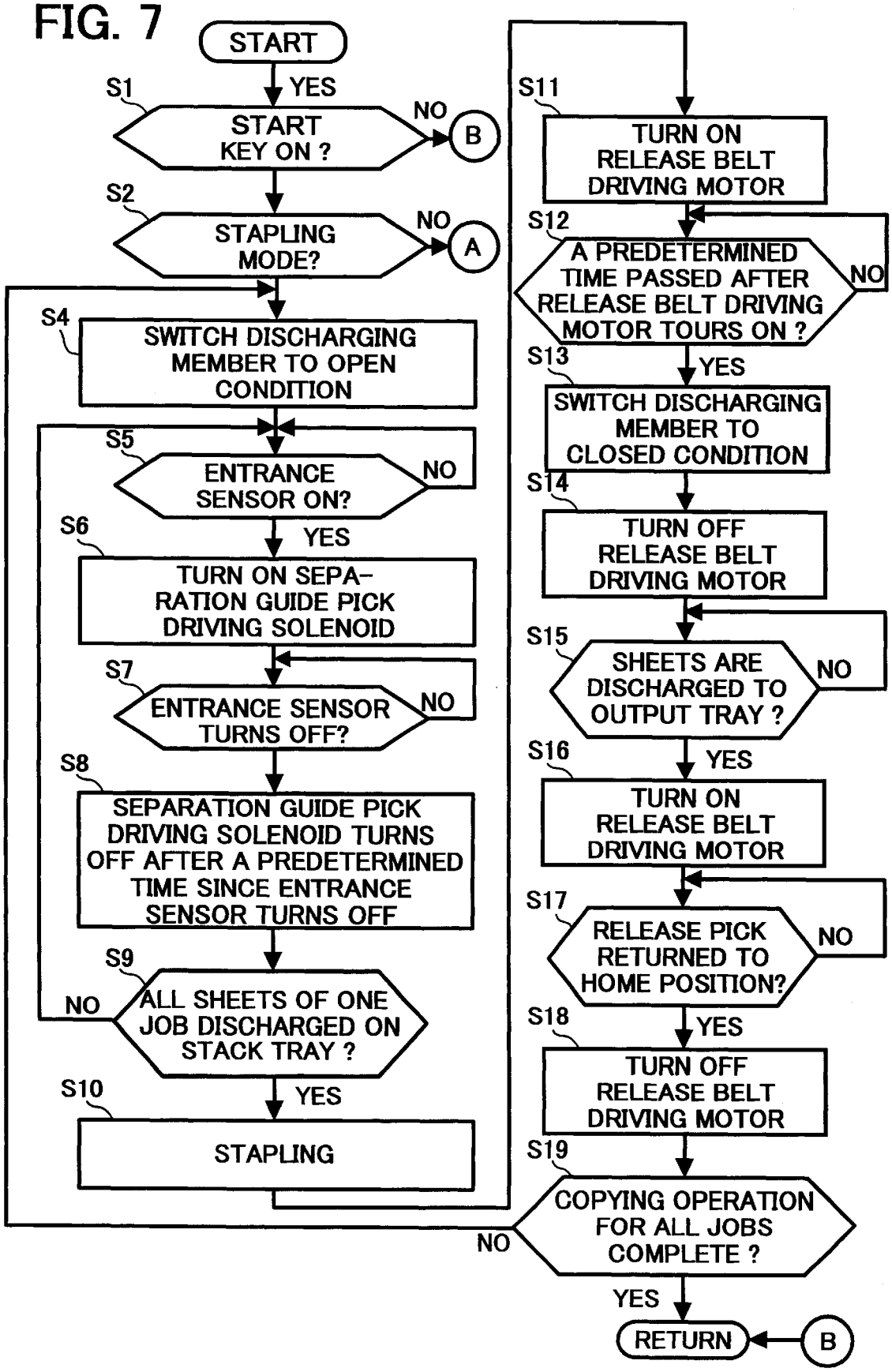
FIG. 7 is a flowchart demonstrating operations of the sheet processing apparatus according to the present invention.
Figure 8:
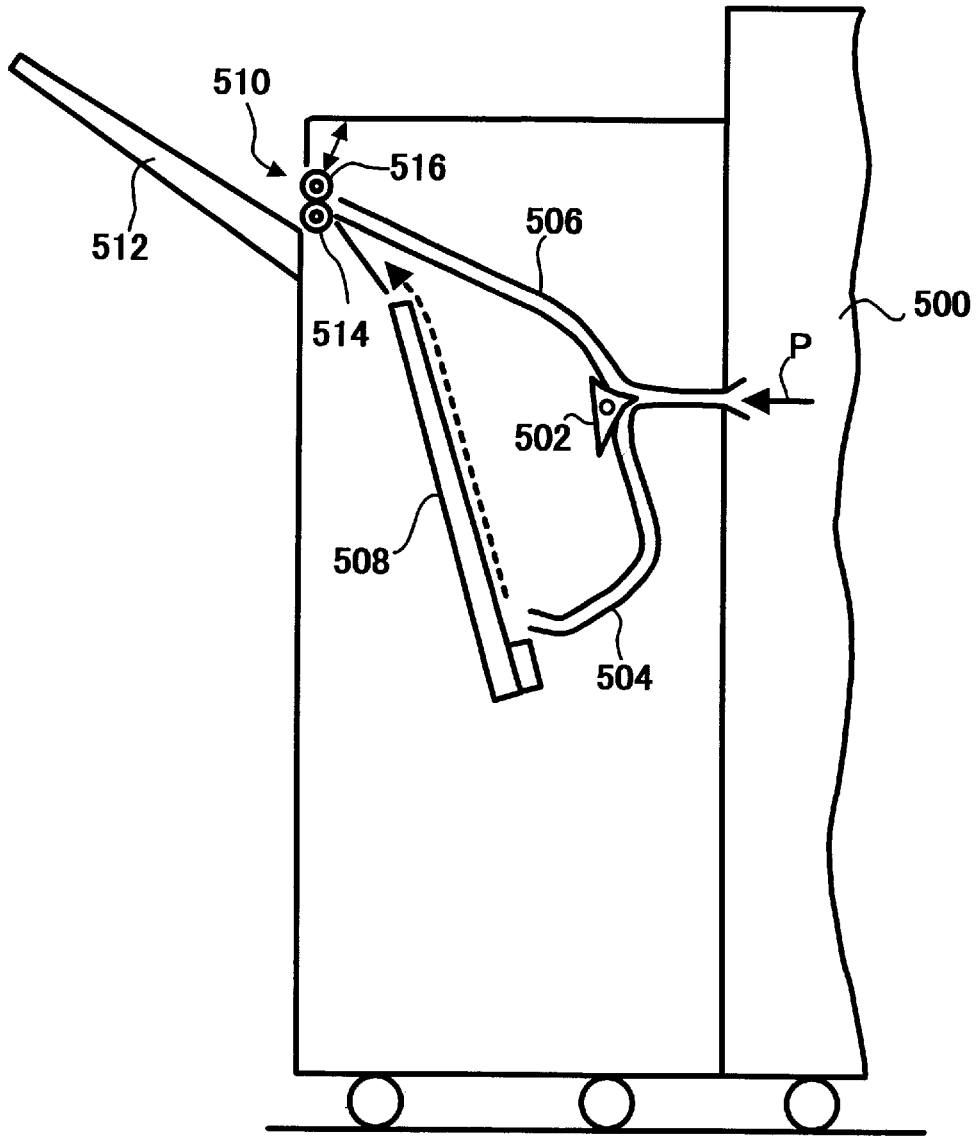
FIG. 8 BACKGROUND ART
FIG. 8 is a schematic side elevational view showing a configuration of a related sheet processing apparatus.
Figure 9A:
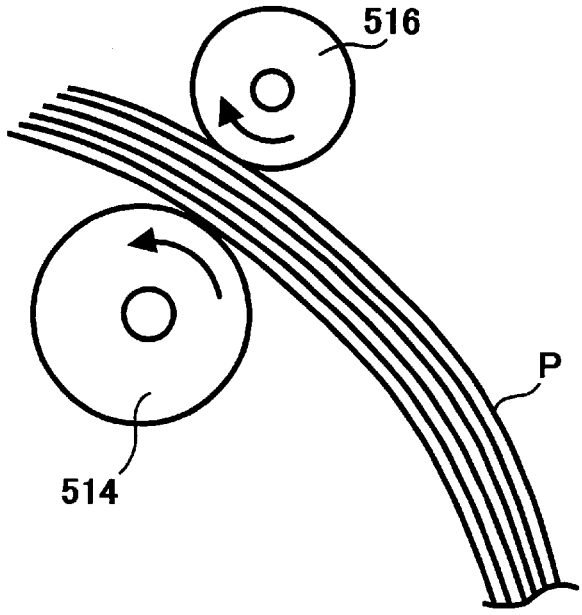
FIGS. 9(*a*) and (*b*) are illustrations showing a problem of a related sheet processing apparatus when a stack of sheets are discharged by being supported and sandwiched by a discharging member at an early timing, FIG. 9(*a*) being a side elevational view showing a deviation of placements between the top and bottom sheets, and FIG. 9(*b*) being a side elevational view showing a bulge generated at around a tail end of the stapled sheets.
Figure 9B:
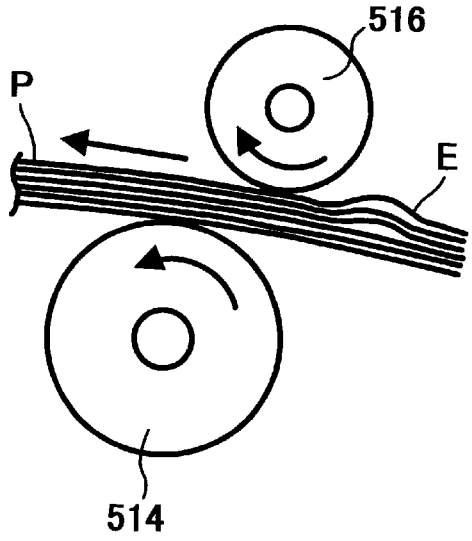

Referring now to a flowchart shown in FIG. 7, the operations of the sheet processing apparatus 10 controlled by the control device 112 are described. First, the control device 112 checks if the start key 103 is turned on at the image forming apparatus 100 (S1). If the start key 103 is on, the control device 112 checks if a stapling mode is selected (S2). If the stapling mode is not selected, the control device 112 executes a non-stapling mode processing A. In the non-stapling mode processing A, the separation guide pick 208 stays at the home position, and the separation guide pick driving solenoid 106 is not turned on. Further, the switch driving motor 214 is not turned on, and the discharging member 110 keeps the closed condition. Accordingly, a sheet conveyed into the sheet processing apparatus 10 from the image forming apparatus 100 is conveyed along the second conveying path R2 and discharged to the output tray 300 being sandwiched by the discharging member 110.

When the stapling mode is selected, the control device 112 controls the discharging member switching device 108 to switch the discharging member 110 to the open condition before a sheet conveyed toward the stack tray 401 reaches the discharging member 110 (S4). Specifically, the control device 112 sends a driving signal to the switch driving motor 214 of the discharging member switching device 108 so as to drive the discharging member 110 to the open condition. More specifically, the discharging member 110 is switched to the open condition before a tip portion of the sheet being conveyed by the pair of conveying rollers 207 reaches a nip portion of the discharging member 110. In this embodiment, the discharging member 110 is switched to the open condition before positioning the separation guide pick 208 in a position to guide a sheet to the first conveying path R1 . After the discharging member 110 is switched to the open condition, the control device 112 checks if the entrance sensor 204 is turned on (S5). If the entrance sensor 204 is turned on, the control device 112 turns on the separation guide pick driving solenoid 106 (S6). If the separation guide pick driving solenoid 106 is turned on, referring to FIG. 3, the separation guide pick 208 is switched from the position for guiding a sheet to the second conveying path R2 (indicated by a solid line) to the position for guiding the sheet to the first conveying path R1 (indicated by a two-dots-and-dash line), and the conveyed sheet is discharged to the stack tray 401 as illustrated in the drawing.

After the separation guide pick driving solenoid 106 is turned on, the control device 112 checks if the entrance sensor 204 is turned off (S7). If the entrance sensor 204 is off, the separation guide pick driving solenoid 106 is turned off after a predetermined time since the entrance sensor 204 is turned off (S8), and the separation guide pick 208 returns to the position to guide a sheet to the second conveying path R2. After this, as illustrated in FIG. 3, the striking roller 219 swings as indicated by a two-dots-and-dash line to contact a surface of the sheet P. After contacting, the striking roller 219 rotates to move the sheet P in the direction to the end fence 403 provided at the lower part of the stack tray 401, so that the tail end of the sheet P in the sheet conveying direction is made to abut against the end fence 403 to be aligned with other sheets P in the conveying direction. When the tail end of the sheet P is abutting against the end fence 403, the striking roller 219 returns to the position indicated by a solid line to wait for a next conveyed sheet P.

As described above, when the tail end of the sheet P passes through the pair of conveying rollers 207, the separation guide pick 208 returns to the home position to guide the sheet P to the second conveying path R2 and causes the first conveying path R1 to be closed. Consequently, the sheet P already discharged to the stack tray 401 is prevented from going back in the direction of the pair of conveying rollers 207. As illustrated in FIG. 3, the tail end of the sheet P is guided near to the stack tray 401 by and along an extended guide plate 409 made of a flexible member and provided on the entrance guide plate 205, and the sheet falls toward the end fence 403 by gravity and then is moved by the striking roller 219 along the stack tray 401 to be abutted against the end fence 403. The abutments enable the sheets P to be aligned in the conveying direction.

When a signal of the size of a sheet P is received from the copying machine 100, the jogger fence 402 and the side fence 408 move to a waiting position closer to each other from each home position, so that each side edge of the sheet P to be stacked on the stack tray 401 is within the inner space of the U-shaped portion of the jogger fence 402 and the side fence 408.

For example, the jogger fence 402 and the side fence 408 move such that the each a inner surface of the side board of the fences is at a position of 10 mm outward from the position where each edge of the sheet P to be stacked will be positioned. Specifically, the respective distances of moving inward depend on the length of the sheet P in a direction perpendicular to the sheet conveying direction. The jogger fence 402 is moved by the operation of the drive motor 414 and the timing belt 415, and the side fence 408 is moved by the operation of the drive motor 411 and the timing belt 412. After the sheet P is discharged to the stack tray 401, the sheet P moves or falls down by gravity and further is moved by the operation of the striking roller 219 in the direction to the end fence 403 such that the tail end of the sheet in the conveying direction abuts against the end fence 403. Then, only the jogger fence 402 additionally moves to push the sheet P toward the side fence 408 (in the direction indicated by an arrow N shown in FIG. 5) such that the sheet P abuts against a side board 408*a* of the side fence 408 to be aligned. After the alignment, the jogger fence 402 returns to the above-mentioned waiting position for waiting for another sheet P to be discharged to the stack tray 401. When another sheet P is discharged to the stack tray 401, the jogger fence 402 repeats the above described aligning operations. As described, the sheet P is always discharged to the stack tray 401 with each side end portion of the sheet P passing through the inner space formed by the U-shaped portion of the jogger fence 402 and that of the side fence 408. So that, the above-described alignments for the sheet can be operated while each side end of the sheet P is passing through the inner space formed by the U-shaped portion of the jogger fence 402 and the side fence 408. Therefore, even when the sheets are curled either in the sheet conveying direction or in the direction perpendicular to the sheet conveying direction, the sheets can be prevented from bouncing out of the stack tray 401.

Now, returning to FIG. 7, the control device 112 checks if the last page of a stack of sheets P is discharged to the stack tray 401, in other words, if all of the sheets of one job are discharged to the stack tray 401 (S9). When all of the sheets of one job are aligned by the jogger fence 402 by being abutted against the side board 408*a* of the side fence 408, the control device 112 operates the stapler 400, which is integrated into the side fence 408 via a bracket 410 (FIG. 5), to staple the stack of sheets at the corner of the sheets (S10). At this time, the jogger fence 402 stays in the position for pushing the sheets P to the side fence 408 so that the sheets P are prevented from being shifted by stapling of the stapler 400.

After the stack of sheets are stapled by the stapler 400, the control device 112 turns on the release belt driving motor 406 (S11), and the stapled sheets are pushed out along the stack tray 401 toward the output tray 300 by the sheets pushing up device 42. Specifically, when the release belt 405 rotates by turning on the release belt driving motor 406, the release pick 404 moves from the home position to push up the sheets upward along the stack tray 401 by supporting the tail end of the sheets.

In this embodiment, the length of the stack tray 401 in the sheet conveying direction is 300 mm and the distance from the bottom plate of the end fence 403 to the drive roller 217 is 380 mm. Further, the distance from the pair of conveying rollers 207 for discharging the sheet P to the stack tray 401 to the drive roller 217 is 320 mm. More specifically, the distance from a nip portion of the pair of conveying rollers 207 to a nip portion of the discharging member 110 is set to be shorter than a length in a conveying direction of the biggest sized sheet stackable on the stack tray 401. Therefore, when a sheet of which length in the conveying direction is longer than 320 mm, such as a B4, an A3, a Legal, or a Double Letter sized sheet in the portrait configuration, is discharged to the stack tray 401, a tip portion of the sheet once passes through the nip portion of the discharging member 110, and the sheet then falls down or moves toward the end fence 403 as illustrated in FIG. 4.

Figure 4:
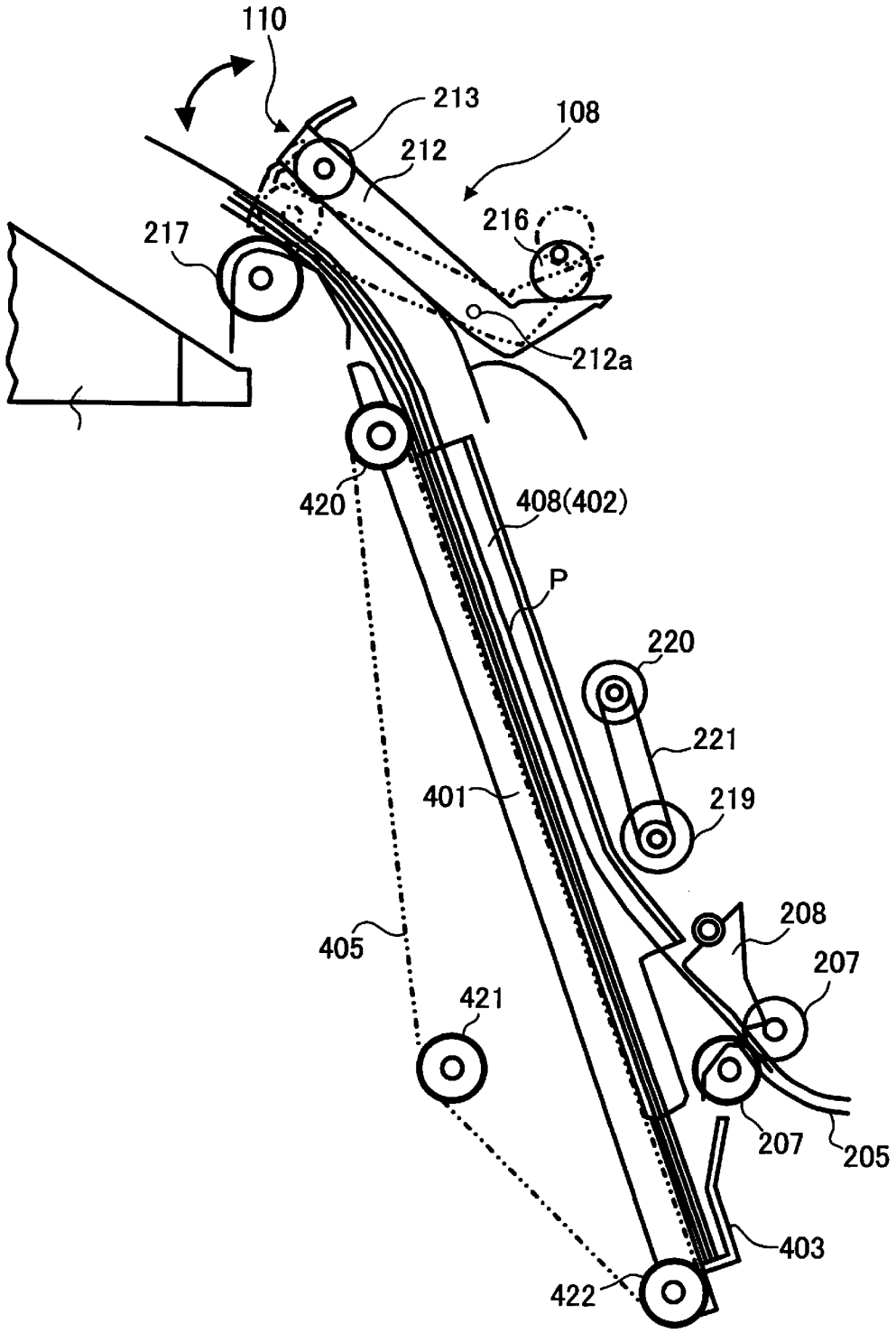
FIG. 4 is a magnified view showing the main part of the apparatus shown in FIG. 1, illustrating a state that the sheets discharged to the stack tray are stacked and further illustrating that a discharging member switches to open/closed conditions.

In addition, when a sheet of which length in the conveying direction is longer than 380 mm, such as an A3 or a Double Letter sized sheet in the portrait configuration, is stacked on the stack tray 401, it is stacked with the tip portion of the sheet passed the nip portion of the discharging member 110 as illustrated in FIG. 4. According to the present invention, as the discharging member 110 can switch to the open condition as described earlier, the sheet processing apparatus 10 can discharge the sheet P to the stack tray 401 without causing the tip portion of the sheet to interfere with the discharging member 110 even when the sheet is longer than the distance from the bottom plate of the end fence 403 to the drive roller 217. Thus, a compact design can be realized.

After the sheets pushing up device 42 pushes up the stapled sheets to some extent, the control device 112 checks if a predetermined time has passed after the release belt driving motor is tuned on (S12). If the predetermined time has passed, the control device 112 controls the discharging member switching device 108 to switch the discharging member 110 to the closed condition as indicated by a two-dots-and-dash line in FIG. 4, and the sheets are discharged to the output tray 300 being sandwiched between the drive roller 217 and the driven roller 213 (S13). When the discharging member 110 is switched to the closed condition, the sheets pushing up device 42 once stops moving, because otherwise (i.e., if the sheets are continuously supported by the release pick 404 until when the release pick 404 turns around the pulley 420 and the sheets are discharged from the stack tray 401), the tip end of the release pick 404 hooks the tail end of the sheets being discharged and thereby hampers the discharging of the sheets (S14). After the sheets are completely discharged to the output tray 300 (S15), the control device 112 drives the sheets pushing up device 42 again (S16) and returns the release pick 404 to the home position. If it is confirmed that the release pick 404 has returned to the home position (S17), the sheets pushing up device 42 stops moving (S18). When the sheets are completely discharged to the output tray 300 in Step S15, the discharging member 110 returns to the open condition. When the control device 112 confirms that the copying operations for all jobs are completed (S19), the control operation ends. If the operations are not completed, the control step returns before S4 and the discharging member 110 is switched to the open condition again.

More specifically for S12, a time when the predetermined time has passed after the release belt driving motor 406 is turned on corresponds to the time when the tail end of the sheets reaches a predetermined position before the discharging member 110. In this embodiment, the discharging member 110 is switched to the closed condition when the tail end of the sheets reaches the position of 80 mm, for example, before the discharging member 110. The position of 80 mm is purely noted for explanatory purposes, and is not to be considered limiting of the present invention, as is the case with other dimensions noted herein. Alternatively, the discharging member 110 may be switched to the closed condition when the stapled part of the sheets reaches the position of 80 mm before the discharging member 110. If the discharging member 110 starts to support and convey the sheets by sandwiching them at a position near the tail end of the sheets, such as, at the position of 80 mm from the tail end of the sheets, a large proportion of the sheets has been already pushed up by the sheets pushing up device 42 by then. Therefore, the above control enables to eliminate or at least reduce a bulge in the top sheet of the stacked sheets which is caused by a deviation of placements between the top and bottom sheets of the stapled stack of sheets. Consequently, bulges of the sheets caused by sheet resistance when the sheets are discharged are avoided, and accordingly, the stapled sheets are discharged smoothly with the above configuration.

The jogger fence 402 stays at the position for pushing sheets and functions as a guide unit for guiding the sheets being discharged to the output tray 300 together with the side fence 408, until the sheets are completely discharged to the output tray 300. Once the sheets are discharged to the output tray 300, the jogger fence 402 returns to the waiting position and waits for a next stack of sheets to align the sheets. In the non-stapling mode, the sheet P conveyed along the second conveying path R2 is discharged to the output tray 300 by being sandwiched between the drive roller 217 and the driven roller 213 of the discharging member 110 which is already in the closed condition.

Obviously, numerous additional modifications and variations of the present invention are possible in light of the above teachings. It is therefore to be understood that within the scope of the appended claims, the present invention may be practiced otherwise than as specifically described herein.

This application is based on Japanese patent application, No. JPAP09-195888 filed in the Japanese Patent Office on Jul. 22, 1997, and on Japanese patent application, No. JPA 10-179170 filed in the Japanese Patent Office on Jun. 25, 1998, and the entire contents of which are hereby incorporated by reference.

What is claimed as new and desired to be secured by Letters Patent of the United States is:

1. A sheet processing apparatus comprising:

a sheet conveying path configured to receive a sheet conveyed from the outside and conveying the sheet therethrough to be discharged;

a stack tray configured to stack a plurality of the conveyed sheets for stapling;

a stapler configured to staple a plurality of the sheets stacked on said stack tray;

an output tray configured to receive the discharged sheets;

said sheet conveying path including (1) a first conveying path configured to guide the conveyed sheet to said stack tray for stapling and (2) a second conveying path that is substantially parallel to the first conveying path and is configured to guide the conveyed sheet to said output tray bypassing said stack tray;

a discharging member configured to discharge the conveyed sheet or sheets guided by said first conveying path or second conveying path;

a discharging member switching device configured to selectively switch said discharging member to a closed condition for discharging the sheet or sheets by sandwiching the sheets; and a controller configured to control said discharging member switching device to switch said discharging member to an open condition before a tip end of the sheet being conveyed through the first conveying path reaches said discharging member.

2. The sheet processing apparatus according to claim 1, wherein said controller controls said discharging member switching device to switch said discharging member to the closed condition from the open condition when a tail end of the sheets stapled by said stapler reaches a predetermined position before said discharging member.

3. The sheet processing apparatus according to claim 1, wherein said controller controls said discharging member switching device to switch said discharging member to the closed condition from the open condition when a stapled part of the sheets stapled by said stapler reaches a predetermined position before said discharging member.

4. A sheet processing apparatus comprising:

a sheet conveying path configured to receive a sheet conveyed from the outside and conveying the sheet therethrough to be discharged;

a stack tray configured to stack a plurality of the conveyed sheets for stapling;

a stapler configured to staple a plurality of sheets stacked on said stack tray;

an output tray configured to receive the discharged sheets;

said sheet conveying path including a first conveying path configured to guide the conveyed sheet to said stack tray for stapling and a second conveying path configured to guide the conveyed sheet to said output tray bypassing said stack tray, a discharging member configured to discharge the conveyed sheet or sheets guided by said first conveying path or second conveying path;

wherein a distance from an entrance for the conveyed sheet to said stack tray to a nip portion of said discharging member is shorter than a length in a conveying direction of a biggest sized sheet stackable on said tray; and wherein said first conveying path and second conveying path are substantially parallel to each other.

5. The sheet processing apparatus according to claim 4, wherein a surface of a sheet stacking side of said stack tray and said second conveying path are substantially parallel to each other.

6. The sheet processing apparatus according to claim 4, wherein said stack tray or said first conveying path and said second conveying path are slanting such that each downstream side of said stack tray, said first conveying path and said second conveying path in a sheet conveying direction is positioned higher than each upstream side thereof.

7. The sheet processing apparatus according to claim 5, wherein said stack tray or said first conveying path and said second conveying path are slanting such that each downstream side of said stack tray, said first conveying path and said second conveying path in a sheet conveying direction is positioned higher than each upstream side thereof.

8. A sheet processing apparatus comprising:

a first conveying path that guides sheets to a stack tray configured to stack a plurality of conveyed sheets;

a second conveying path that is substantially parallel to the first conveying path, and that by-passes the stack tray;

a stapler configured to staple a plurality of sheets stacked on said stack tray;

a sheets pushing out device configured to push out the stapled sheets stapled by said stapler from said stack tray by supporting a tail end of the stapled sheets;

a discharging member configured to discharge the sheets pushed out by said sheets pushing out device on the first conveying path by sandwiching the sheets and to also discharge unstapled sheets conveyed along the second conveying path;

a discharging member switching device configured to selectively switch said discharging member to a closed condition for discharging the sheet or sheets by sandwiching the sheets or to an open condition for discharging the sheet or sheets without sandwiching the sheets; and a controller configured to control said discharging member switching device to switch said discharging member to the open condition before a tip end of the sheet being conveyed toward said stack tray reaches said discharging member.

9. The sheet processing apparatus according to claim 8, wherein said controller controls said discharging member switching device to switch said discharging member to the closed condition from the open condition when a tail end of the sheets stapled by said stapler reaches a predetermined position before said discharging member.

10. The sheet processing apparatus according to claim 8, wherein said controller controls said discharging member switching device to switch said discharging member to the closed condition from the open condition when a stapled part of the sheets stapled by said stapler reaches a predetermined position before said discharging member.

11. A sheet processing apparatus comprising:

a first conveying path that guides sheets to a stack tray configured to stack a plurality of conveyed sheets and arranged such that a downstream side thereof in a sheet conveying direction is positioned higher than an upstream side thereof;

a second conveying path that is substantially parallel to the first conveying path, and that by-passes the stack tray;

a stapler which is provided adjacent to said stack tray and upstream in the sheet conveying direction of said stack tray configured to staple sheets stacked on said stack tray at a tail end part thereof in the sheet conveying direction;

a sheets pushing out device configured to push out the sheets from said stack tray, comprising, a release belt arranged along said stack tray and so as to form a portion substantially parallel to a sheet stacking surface of said stack tray, a hook-shaped release pick protrudingly provided on the release belt, a release belt driving motor configured to drive the release belt, and a transmission member configured to transmit the driving power generated by the release belt driving motor to the release belt, wherein said sheets pushing out device is configured to push out sheets from said stack tray by supporting a tail end of the sheets stapled by said stapler with the release pick and configured with the belt driving motor to drive the release belt via the transmission member;

a pair of discharging rollers, including a drive roller and a driven roller, which discharge the sheets pushed out on the first conveying path by said sheets pushing out device, by sandwiching the pushed out sheets, and which also discharge unstapled sheets conveyed along the second conveying path;

a discharging rollers switching device which selectively switches said pair of discharging rollers to a closed condition to discharge the sheet or sheets by sandwiching the sheet or sheets or to an open condition for discharging the sheet or sheets without sandwiching the sheet or sheets, said discharging rollers switching device comprising a supporting member which supports the driven roller so as to selectively contact or separate from the drive roller so as to form the open condition or the closed condition, and a switch driving motor configured to drive the supporting member; and a controller configured to control said discharging rollers switching device to switch said pair of discharging rollers to the open condition before a tip end of the sheet conveyed toward said stack tray reaches said pair of discharging rollers.

12. The sheet processing apparatus according to claim 9, wherein said controller controls said discharging rollers switching device to switch said pair of discharging rollers to the closed condition from the open condition when a tail end of the sheets stapled by said stapler reaches a predetermined position before said pair of discharging rollers.

13. The sheet processing apparatus according to claim 9, wherein said controller controls said discharging rollers switching device to switch said pair of discharging rollers to the closed condition from the open condition when a stapled part of the sheets stapled by said stapler reaches a predetermined position before said pair of discharging rollers.

* * * * *